US008991952B2

(12) United States Patent
Salice

(10) Patent No.: US 8,991,952 B2
(45) Date of Patent: Mar. 31, 2015

(54) HOOKING DEVICE OF A DRAWER TO A LONGITUDINAL GUIDE

(75) Inventor: Luciano Salice, Carimate (IT)

(73) Assignee: Arturo Salice, S.p.A., Novedrate (IT)

( * ) Notice: Subject to any disclaimer, the term of this patent is extended or adjusted under 35 U.S.C. 154(b) by 0 days.

(21) Appl. No.: 13/808,893

(22) PCT Filed: Sep. 28, 2011

(86) PCT No.: PCT/EP2011/066830

§ 371 (c)(1),
(2), (4) Date: Jan. 7, 2013

(87) PCT Pub. No.: WO2012/079793

PCT Pub. Date: Jun. 21, 2012

(65) Prior Publication Data

US 2013/0113356 A1 May 9, 2013

(30) Foreign Application Priority Data

Dec. 15, 2010 (IT) ..... MI2010A002294

(51) Int. Cl.
*A47B 88/00* (2006.01)
*A47B 88/04* (2006.01)

(52) U.S. Cl.
CPC ..... *A47B 88/0422* (2013.01); *A47B 2088/0433* (2013.01); *A47B 2088/0437* (2013.01)
USPC ..... 312/334.4; 312/334.5

(58) Field of Classification Search
CPC ..... A47B 88/16; A47B 88/0477; A47B 88/0422; A47B 88/0418; A47B 88/044
USPC ..... 312/333, 334.1, 334.2, 334.4, 334.5, 312/334.6, 334.7, 334.8, 348.4
See application file for complete search history.

(56) References Cited

U.S. PATENT DOCUMENTS

| | | | | |
|---|---|---|---|---|
| 5,588,729 | A * | 12/1996 | Berger | 312/334.4 |
| 6,913,334 | B2 * | 7/2005 | Weichelt | 312/334.4 |
| 6,945,618 | B2 * | 9/2005 | Kim et al. | 312/334.4 |
| 8,424,984 | B2 * | 4/2013 | Ritter | 312/333 |
| 2002/0158557 | A1 | 10/2002 | Weichelt | |

(Continued)

FOREIGN PATENT DOCUMENTS

| | | | |
|---|---|---|---|
| DE | 20107278 | U1 | 8/2001 |
| DE | 2002007006549 | U1 | 7/2007 |

OTHER PUBLICATIONS

International search report mailed Jan. 27, 2012, for International Application No. PCT/EP2011/066830.

*Primary Examiner* — Daniel Rohrhoff
(74) *Attorney, Agent, or Firm* — Blank Rome LLP

(57) ABSTRACT

The hooking device of a drawer to a longitudinal guide, comprises a support body fixable to a front and/or a bottom of the drawer and is provided with an oscillating command lever of a hooking organ of the support body to the guide, the support body exhibiting a first part of body fixable to the drawer and at least one second part of body slidably connected with the first part of body and adjustably positioned at least in the longitudinal direction of the guide, the lever and the hooking organ being solidly constrained to said second part of body in displacement thereof in the longitudinal direction of the guide, at least first adjustment means being further provided for varying a position of said second part of body with respect to the first part of body in the longitudinal direction of the guide for adjusting the position of the drawer with respect to the guide in the longitudinal direction of the guide.

16 Claims, 5 Drawing Sheets

(56) References Cited

U.S. PATENT DOCUMENTS

2004/0227440 A1 11/2004 Booker et al.
2013/0257244 A1* 10/2013 Salice ..... 312/319.1
2014/0015390 A1* 1/2014 Grabherr ..... 312/334.4
2014/0055020 A1* 2/2014 Gasser ..... 312/333

* cited by examiner

HOOKING DEVICE OF A DRAWER TO A LONGITUDINAL GUIDE

CROSS REFERENCE TO RELATED APPLICATIONS

This application is a U.S. national phase application of International Application No. PCT/EP2011/066830, filed Sep. 28, 2011, designating the United States, which claims benefit from Italy Application No. MI2010A 002294, filed Dec. 15, 2010, both of which are hereby incorporated herein by reference in their entirety.

FIELD

The present invention relates to a hooking device for connection of a drawer, or of another sliding component of a furniture, to an extractable part of a longitudinal guide for drawers or others, particularly apt for connecting in a controllable way the front portion of a drawer with the extractable part of a guide of the pre-assembled type.

BACKGROUND

In the furniture, the use of hooking devices is generally known, for making a connection of the front and/or bottom of drawers to the front end of a removable part of longitudinal guides which can be fixed to the internal sides of a furniture, which devices traditionally comprise a support body which can be fixed to the front and/or the bottom of the drawer, a movable hooking means protruding from the body itself in order to engage in a hole or lateral cavity of the removable part of the guide, and suitable manual control means operatively connected with the hooking means in order to permit disengaging the drawer from the guide.

The traditionally known hooking devices can be provided with suitable regulating means able to permit a displacement in a lateral direction and/or in height of the front portion of the drawer, in order to regulate the mutual position of the frontal parts of the drawers, permitting an appreciable aesthetic result.

In the years however the need arose to place also a front adjustment of the drawer in a longitudinal direction; in particular, such need has mainly arisen with reference to the ergonomic developed for closing the drawers, which lead have an ever more diffused use of longitudinal guides having automatic reclosing systems of the drawer, commonly named of the "self-closing" type.

Such closing systems in fact provide a stop means which defines the end closing position of the front of the drawer; therefore, should the longitudinal guides be fixed in a non precise way, the possibility exists that the front stops in a position detached from the furniture, with a consequent poor aesthetic result.

Similar problems arose also with reference to the use of longitudinal guides having disengaging and pressure expulsion systems of the drawer, commonly named of the "push" type, developed within the well-established design trend, aiming to eliminate any handle or manual gripping means.

In fact, for the actuation of the release mechanism of such systems of the push type, it is essential that the front of the drawer stops at a well defined distance from the furniture; therefore in the case of an imprecise fixing of the longitudinal guides, the front of the drawer could become too close to the furniture, with a consequent lack of the space necessary for the actuation of the release and pull-out mechanism, or it could become too detached from the furniture, with consequent drawbacks of aesthetic nature.

In order to eliminate the problems and drawbacks cited before, separate regulating devices are traditionally provided, applied between the frontal part and the lateral walls of the drawer, in order to be able to adjust the position of the front part itself in a longitudinal direction.

However such solution entails a greater constructive complexity of the drawer and greater costs due to the need of providing for the additional adjustment devices as cited before.

SUMMARY

Purpose of the present invention therefore is to provide a hooking device for connection of a drawer with an extractable part of a longitudinal guide for drawers, which permits to overcome the limitations and drawbacks of the known devices. Within this technical task, a main purpose of the present invention is therefore to provide a hooking device of the type cited before, which is constructively simple and permits to correctly position the front part of the drawer without the need of providing separate adjustment devices of the front part itself.

Further aim of the present invention is to provide a hooking device of the kind cited before, which is extremely versatile for performing the different regulations necessary for the right positioning of the front of the drawer.

This and further aims of the invention are reached by a hooking device of a drawer to a longitudinal guide, comprising a support body which can be fixed to the front and/or the bottom of the drawer and provided with an oscillating command lever of a hooking organ of the support body to the guide, characterized in that said support body exhibits a first part of body which can be fixed to the drawer and at least one second part of body slidably connected to said first part of body and which can be adjustably positioned at least in the longitudinal direction of the guide, said lever and said hooking organ being solidly constrained to said second part of body in displacement thereof in the longitudinal direction of the guide, first adjustment means being further provided for varying the position of said second part of body with respect to the first part of body in the longitudinal direction of the guide for adjusting the position of the drawer with respect to the guide in the longitudinal direction of the guide.

Preferably said second part of body supports second adjustment means able to vary the position of the support body in a first direction which is perpendicular to the longitudinal direction of the guide for height-regulating the position of the drawer with respect to the guide.

Preferably said second adjustment means comprise a wedge-shaped element hinged to said second part of body with a rotation axis oriented in said first direction.

Preferably said second adjustment means further comprise a manual gripping element for activating said wedge-shaped element.

Preferably said second adjustment means are positioned on an opposite side to said first adjustment means with respect to the fulcrum of oscillation of said lever.

Preferably said support body has at least one third part of body slidably connected to said first part of body and which can be positioned in an adjustable way in a second direction which is both parallel to the plane of the drawer, and orthogonal to the longitudinal direction of the guide, said second part of body being further connected with said third part of body in a slidable way, and being positioned in an adjustable way in the longitudinal direction of the guide, third adjustment means being further provided able to vary the position of the assembly comprising said second and third part of body with respect to said first part of body in said second direction for the lateral adjustment of the position of the drawer with respect to the guide.

Preferably said third adjustment means are positioned from the same part of said first adjustment means with respect to the fulcrum of oscillation of said lever.

In a first preferred embodiment of the invention said first adjustment means comprise a wheel coaxially screwed to a worm, in which the wheel is so bound to said first part of body, that it presents a single rotational degree of freedom around its own axis, said worm being fixed to said second part of body with orientation in the longitudinal direction of the guide.

Preferably said wheel is positioned in a seating afforded in said first part of body on which an access window is superposed, afforded in said second part of body for manually activating the wheel.

In a second preferred embodiment of the invention said first adjustment means comprise a cylindrical pin contrained rotatably in a cylindrical guide hole afforded on said third part of body and a cam supported by said pin in an eccentric position and engaged in a slot afforded on said second part of body.

In such case said first adjustment means further comprise a manual gripping element for activating said cam.

In said second preferred embodiment of the invention said third adjustment means comprise a cylindrical pin constrained rotatably in a cylindrical guide hole afforded on said first part of body, and a cam supported in an eccentric position by said pin and engaged in a slot afforded on said third part of body.

In such case said third adjustment means further comprise a manual gripping element for activating said cam.

BRIEF DESCRIPTION OF THE DRAWINGS

What described above will be illustrated thereafter with reference to some preferred but non limitative embodiments of the invention on the base of the annexed drawings, in which.

Equivalent part in the various preferred embodiments of the invention are indicated with the same reference character.

DETAILED DESCRIPTION

Figure 1:
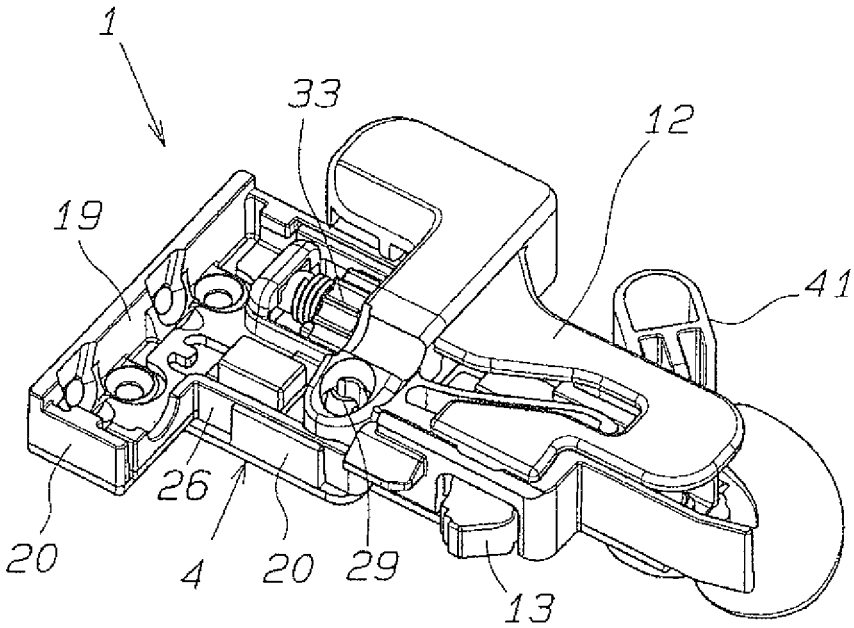
FIG. 1 is a perspective view of a hooking device according to a first embodiment of the invention.

With reference to cited figures, a hooking device 1 of a drawer 2 is shown to a removable part 14 of a longitudinal guide 3 fixed on an internal side of the side of furniture housing the drawer 2.

The hooking device 1 comprises a support body 4 positioned on the external side of the bottom of the drawer 2 at the angle between the front 5 of the drawer 2 and a shoulder 6 of the drawer 2.

The support body 4 is provided with an oscillating command lever 12 of a hooking organ 13 of the support body 4 to the guide 3.

The hooking organ 13 is movable between a hooking position of the drawer 2 to the removable part 14 of the guide 3, at which it engages in a seat 15 made on the removable part 14 of the guide 3, and a release position at which it is disengaged from the seat 15.

Advantageously, the support body 4 has a first part of body 16 fixable to the drawer 2 and at least one second part of body 17 connected slidably with the first part of body 16 and which can be adjustably positioned at least in the longitudinal direction of the guide 3.

The lever 12 and the hooking organ 13 are solidly constrained to said second part of body 17 in displacement thereof with respect to the first part of body 16, in the longitudinal direction of the guide 3.

In particular the lever 12 is hinged to the second part of body 17 with a hinge axis 29, and is made of a single piece both with the hooking organ 13 and with the manual gripping element of the lever 12 mutually positioned at opposite sides with respect to the hinge axis 29 of the lever 12.

The lever 12 can oscillate in the sense bringing the hooking organ 13 in the release position in contrast with an elastic element 31 of automatic recharging of the hooking organ 13 in the hooking position.

The elastic element 25 comprise a flexible leaf spring also made as a single piece with the lever 12 and having its free end resting on a stop 32 made on the second part of body 17.

Advantageously the hooking device 1 has first adjustment means able to vary the position of the second part of body 17 with respect to the first part of body 16 in the longitudinal direction of the guide 3 for the front adjustment of the drawer 2, that is for the adjustment of the position of the drawer 2 with respect to the guide 3 in the longitudinal direction of the guide 3.

The second part of body 17 further supports second adjustment means able to vary the position of the support body 4 in a first direction orthogonal to the longitudinal direction of the guide and to the bottom of the 2 for height-regulating the position of the drawer 2 with respect to the guide 3.

The second adjustment means are positioned on an opposite side to said first adjustment means with respect to the hinge axis of the lever 12 and comprise a wedge-shaped element 39 hinged to the second part of body 17 with hinge axis 40 oriented in said first direction, that is parallel to the hinge axis 29 of the lever 12, and a manual gripping element 41 for actuating the wedge-shaped element 39, made of a single piece with this.

Figure 2:
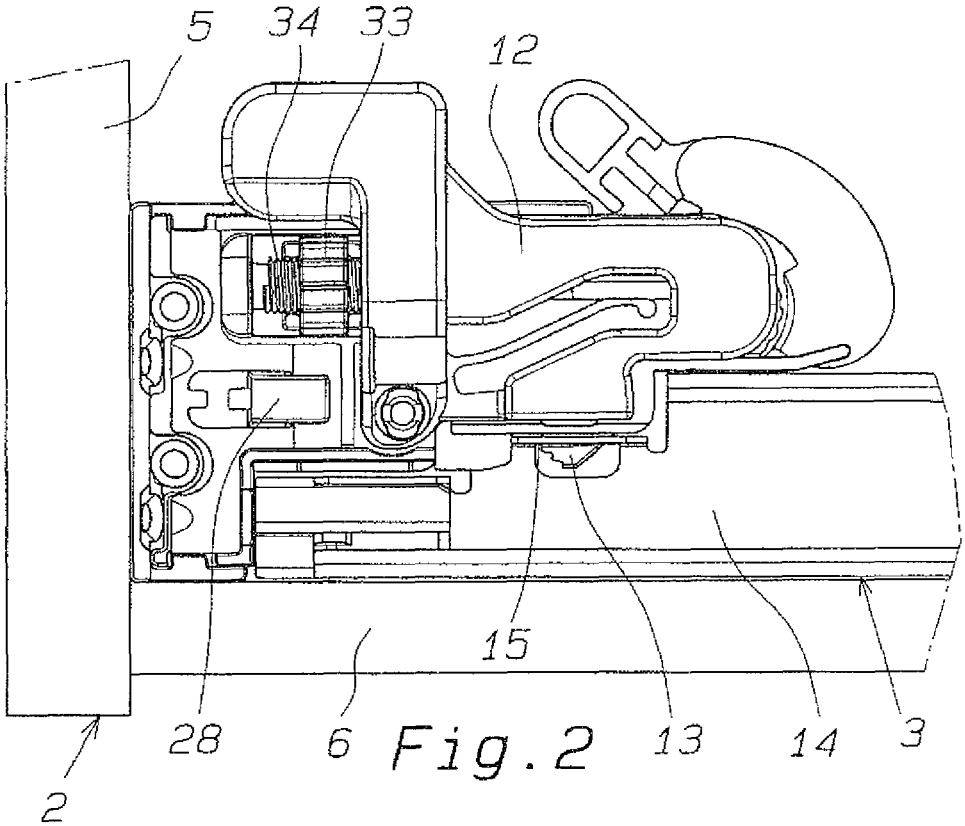
FIG. 2 is a plan view, from below, of the hooking device of FIG. 1, in a condition assembled with a drawer and a longitudinal guide.
Figure 3:
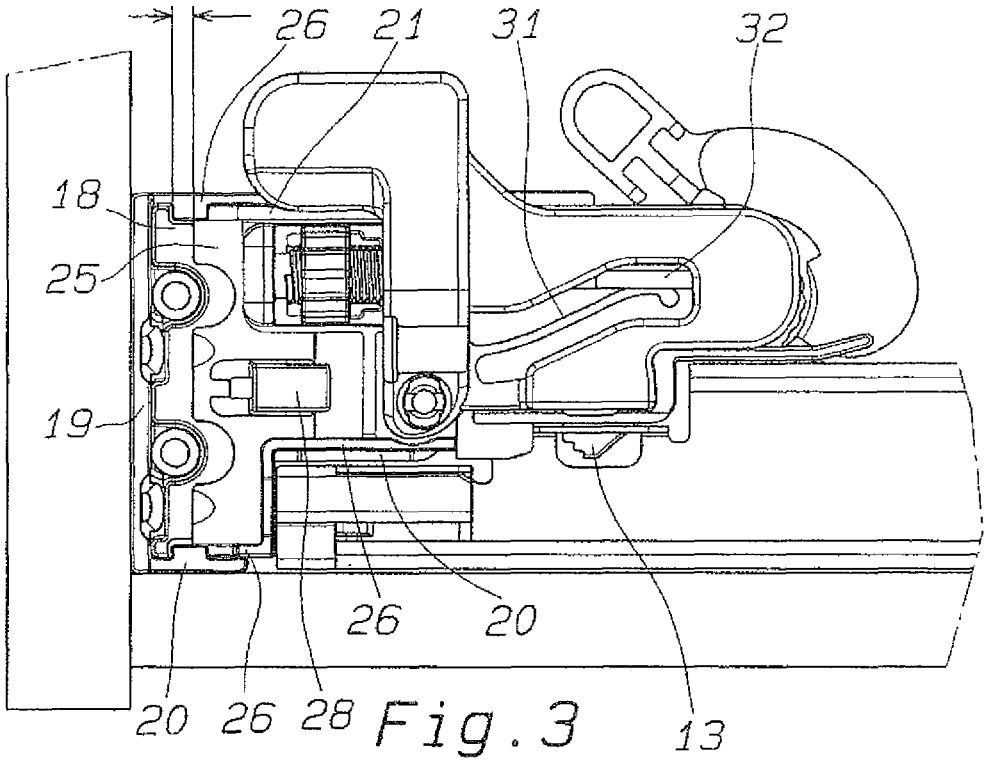
FIG. 3 shows the device of FIG. 2 after the adjustment of the second part of body in the longitudinal direction of the guide of the drawer, in which the amount of translatory displacement of the second part of body is indicated by the distance between two opposed arrows.
Figure 4:
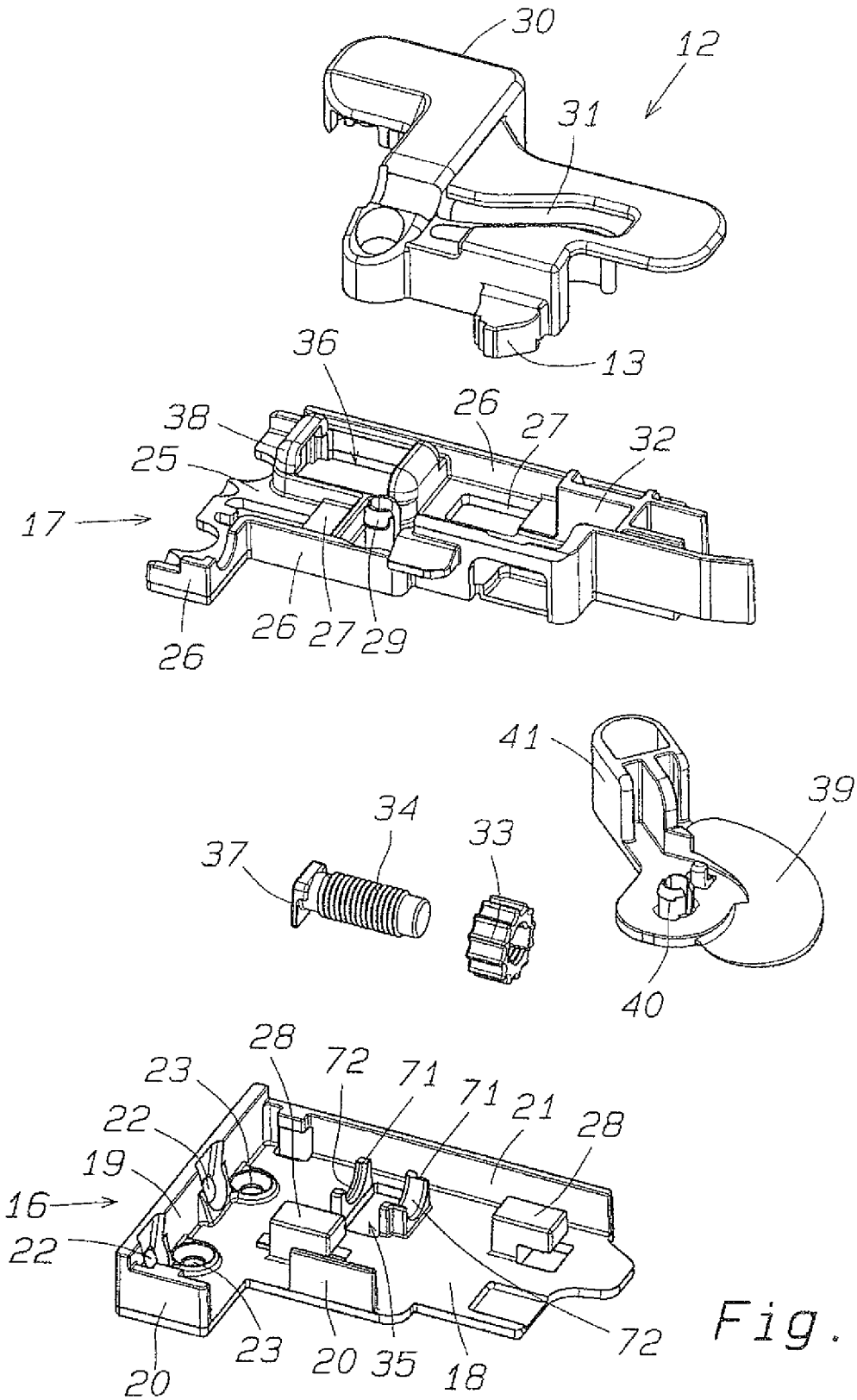
FIG. 4 is a perspective view of the hooking device of FIG. 1 in an exploded condition.
Figure 5:
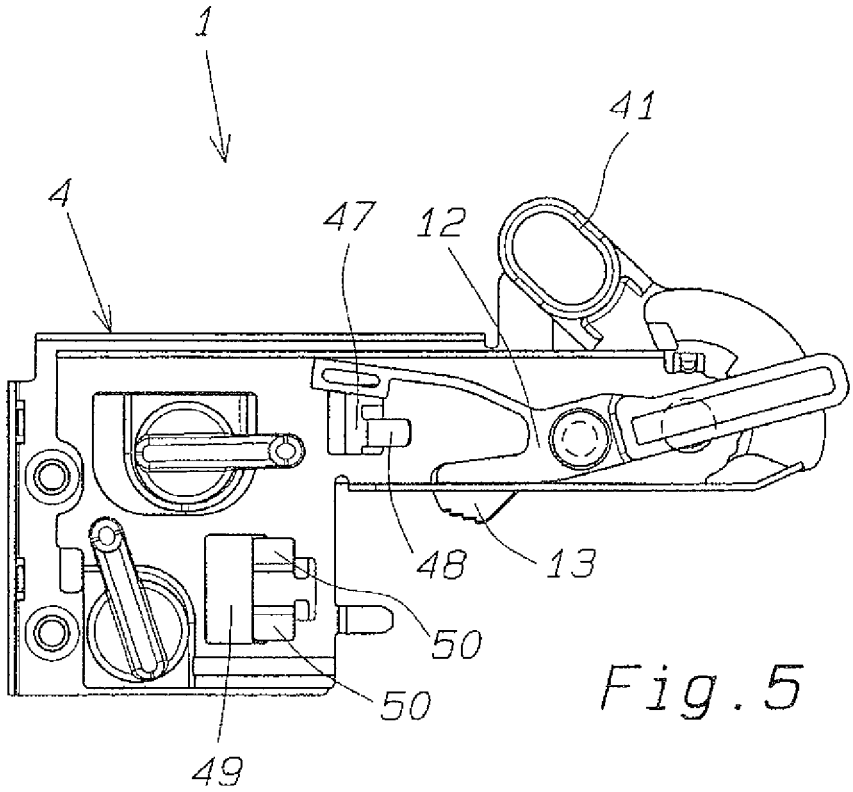
FIG. 5 is a plan view, from below, of a hooking device according to a second embodiment of the invention.
Figure 6:
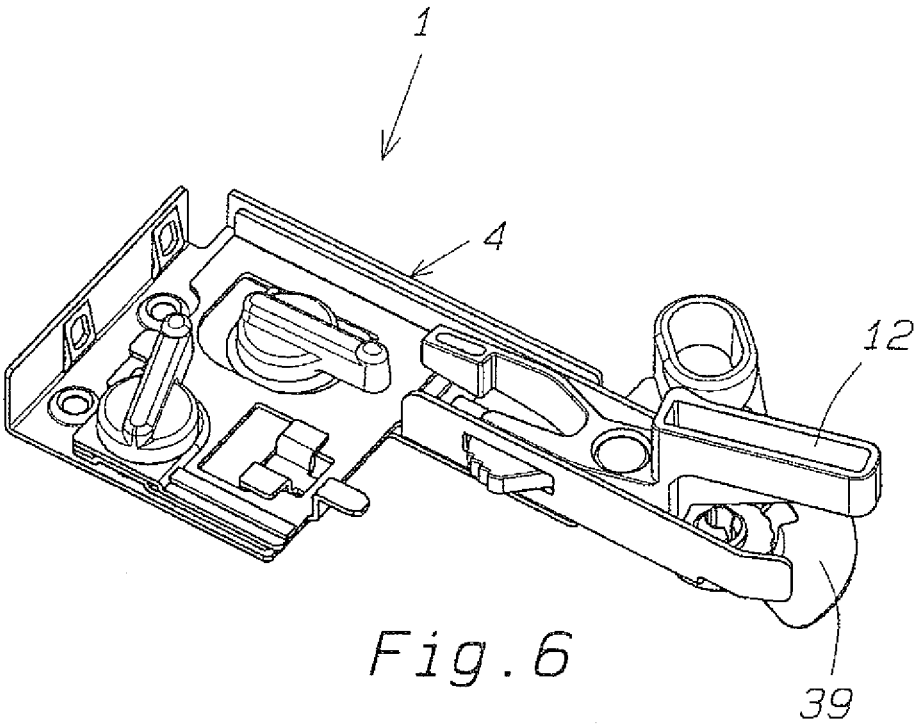
FIG. 6 is a perspective view of the hooking device of FIG. 5.
Figure 7:
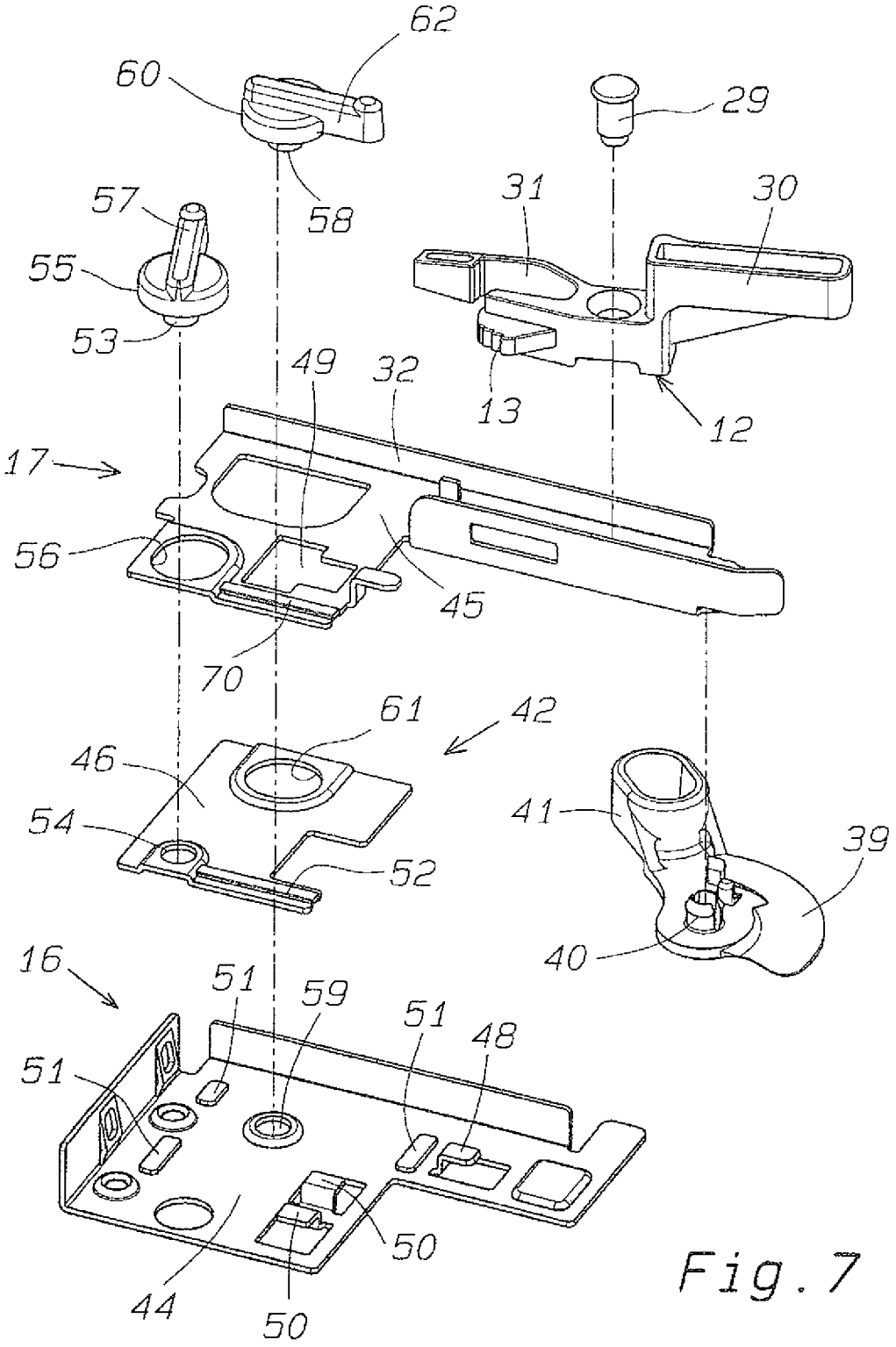
FIG. 7 is a perspective view of the hooking device of FIG. 4 in an exploded condition.

Reference is now made in particular to the first preferred embodiment of the invention illustrated in FIGS. 1-4.

The first part of body 16 has a base plate 18 which can rest on the external side of the bottom of the drawer 2.

The base plate 18 at its front edge has an orthogonal fin 19 destined to rest on the internal side of the front 5 of the drawer 2, at its external edge two orthogonal fins 20, and at its external lateral edge an orthogonal fine 21 destined, in cooperation with the fins 20, to guide the sliding of the second part of body 17 in the longitudinal direction of the guide 3.

The base plate 18 and the fin 19 have holes 22, 23 for fixing the first part of body 16 to the drawer 2.

The external lateral edge of the base plate 18 has two parallel mutually offset lengths from which two fins 20 protrude in the direction orthogonal to the longitudinal direction of the guide 3 such to create a positioning space of the front end of the removable part 14 of the guide 3 which therefore is laterally confined between the most internal fin 20 and the shoulder 6 of the drawer 2.

The second part of body 17 has a base plate 25 having parallel orthogonal fins 26 mutually offset which slidably engage with the orthogonal fins 20, 21 of the base plate 18 for guiding the sliding of the second part of body 17 in the longitudinal direction of the guide 3.

The external lateral edge of the base plate 25 also has two fins 26 mutually offset in order to approach the fins 20 of the base plate 18 for delimiting the positioning space of the front end of the removable part 14 of the front guide.

The base plate 25 has suitable slots 27 in which sliding teeth 28 engage protruding from the base plate 18 for the mutual engagement between the plates 18 and 25 with parallel orientation and suitable to permit the sliding of the base plate 25 with respect to the base plate 18 in the longitudinal direction of the guide 3.

The first adjustment means comprise a wheel 33 coaxially screwed on a endless screw 34.

The wheel 33 is bound to the first part of body 16 such to have a single rotational degree of freedom about its own axis, whereas the endless screw 34 is fixed to said second part of body 17 and orientated in the longitudinal direction of the guide 3.

In particular the wheel 33 is positioned in a seating 35 afforded on the base plate 18 and having shoulders 71 which axially block the wheel 33 and apically have an arched profile 72 for housing the endless screw 34.

On the seating 35 an access window 36 is superposed, afforded on the base plate 25 for manually activating the wheel 33.

The endless screw 34 has a flat head 37 housed in a seating 38 of a wall delimiting the front side of the access window 36, afforded on the base plate 25.

Substantially the wheel 33, when rotating, not being able to translate actuates in translation in the longitudinal direction of the guide 3 the endless screw 34 and consequently the base plate 25, the lever 12 and the hooking organ 13 integral with it. In this way the front adjustment of the drawer 2 is reached.

The height adjustment of the drawer can instead be reached by rotating the wedge-shaped element 39 penetrating between the bottom of the drawer 2 and the guide 3. The angle of rotation of the wedge-shaped element 39 determines the amount of adjustment.

Reference is now made to the second preferred embodiment of the invention which functionally differs from the first one due to the fact that a lateral adjustment of the drawer 2 is also possible.

In this case the support body 4 also has a third part of body 42 slidably connected with the first part of body 16 and which can be adjustably positioned in a second direction orthogonal to both said first direction and said second longitudinal direction of the guide 3.

The second part of body 17 is further slidably connected with the third part of body 42 and can be adjustably positioned in the longitudinal direction of the guide 3. Third adjustment means are further provided able to vary the position of the assembly comprising the second and third part of body 17 and 42 with respect to the first part of body 16 in said second direction for the lateral adjustment of the position of the drawer 3 with respect to the guide 2.

The third adjustment means are positioned from the same part of the first adjustment means with respect to the fulcrum of oscillation of the lever 12. The first part of body 16 comprises a base plate 44, the second part of body 17 comprises a base plate 45 and the third part of body 42 comprises a plate 46 interposed between the base plates 44 and 45.

Also in this case the external lateral edge of the base plates 44 and 45 has a positioning space of the front end of the removable part 14 of the guide 3.

The base plate 45 has first slots 47 in which first teeth 48 slidably engage, protruding from the base plate 44 for the mutual engagement between the plates 44 and 45 with parallel orientation suitable to permit the sliding of the base plate 45 with respect to the plate 44 in the longitudinal direction of the guide 3 for the front adjustment of the drawer 3, and second slots 49 in which second teeth 50 slidably engage protruding from the plate 44 for the mutual engagement between the plates 44 and 45 with parallel orientation and suitable to permit the sliding of the plate 45 with respect to the plate 44 in said second direction for the lateral adjustment of the drawer 3.

The plate 46 is coupled to the plate 44 in a slidable way orthogonal to the longitudinal direction of the guide 3, further being integral with the plate 44 itself in the longitudinal direction of the guide 3, through guide ribs 51 provided on the plate 44 and cooperating with the front and rear edge of the plate 46 such to slidably guide the plate 46 with respect to the plate 44 in said second direction.

The plate 46 is made integral with the plate 45 in the displacement in said second direction by a protrusion 52 afforded on the plate 46, which extends in the longitudinal direction of the guide 3 and is slidably engaged in a recess 70 of conjugated shape afforded in the plate 45 for slidably guiding in the longitudinal direction of the guide 3 the plate 45 with respect to the plate 46.

The first adjustment means comprise a cylindrical pin 53 pivotally bound inside a cylindrical guide hole 54 afforded on the plate 46, and a cam 55 of circular shape supported by the pin 53 in an eccentric position and engaged in an elongated hole 56 afforded on the base plate 45.

The first adjustment means further comprise a manual gripping element 57 for the actuation of the cam 55.

The manual gripping element 57 radially protrudes from the portion of the cam 55 external from the elongated hole 56.

For the front adjustment of the drawer 2 the gripping element 57 is rotated actuating the eccentric cam 55 which in turn interferes with the elongated hole 56 so actuating the translation of the plate 45 with respect to the plate 46 in the longitudinal direction of the guide 3.

The third adjustment means comprise a cylindrical pin 58 pivotally bound in a cylindrical guide hole 59 afforded on the plate 44, and a cam 60 of circular shape supported by the pin 58 in an eccentric position and engaged in an elongated hole 61 afforded on the plate 46.

The third adjustment means further comprise a manual gripping element 62 for activating the cam 60.

The manual gripping element 62 radially protrudes from the portion of the cam 60 external to the elongated hole 61.

For the lateral adjustment of the drawer 2 the manual gripping element 62 is rotated actuating the eccentric cam 60 which in turn interferes with the elongated hole 61 so activating the integral translation of the plates 45 and 46 with respect to the plate 44 in said second direction.

The height adjustment of the drawer is made in a way similar to the previously described case for activating the lever 41.

The present invention therefore provides a particularly simple and versatile hooking device for performing said correct front and eventually lateral and height adjustment of the drawer.

Naturally the hooking device according to the present invention can either only provide for the front adjustment, or only the front and lateral adjustment, or only the front and height adjustment, or the front and lateral and height adjustment.

The hooking device so conceived is susceptible of many modifications and variations, all within inside the inventive concept; furthermore, all details can be substituted with technically equivalent elements.

In practice the used materials, and also the dimensions, can be of any kind according to the needs and the state of the art.

The invention claimed is:

1. A hooking device of a drawer to a longitudinal guide, comprising a support body fixable to a front, a bottom, or the front and the bottom of the drawer and provided with an oscillating command lever of a hooking organ of the support body to the guide, wherein said support body exhibits a first part of body fixable to the drawer and at least a second part of body connected slidably to the first part of body and adjustable at least in a longitudinal direction of the guide, said longitudinal direction being a direction in which said drawer moves in and out of a piece of furniture, said lever and said hooking organ being solidly constrained to said second part of body in displacement thereof in the longitudinal direction of the guide, at least first adjustment means being further provided for varying a position of said second part of body with respect to the first part of body in the longitudinal direction of the guide for adjusting a position of the drawer with respect to the guide in the longitudinal direction of the guide.

2. The hooking device of a drawer to a longitudinal guide of claim 1, wherein said second part of body comprises second adjustment means destined to vary a position of the support body in a first direction which is perpendicular to the longitudinal direction of the guide for height-regulating the position of the drawer with respect to the guide.

3. The hooking device of a drawer to a longitudinal guide of claim 2, wherein said second adjustment means comprise a wedge-shaped element hinged to said second part of body with a rotation axis orientated in said first direction.

4. The hooking device of a drawer to a longitudinal guide of claim 3, wherein said second adjustment means further comprise a manual gripping element for activating said wedge-shaped element.

5. The hooking device of a drawer to a longitudinal guide of claim 2, wherein said second adjustment means are positioned on an opposite side to said first adjustment means with respect to the fulcrum of oscillation of said lever.

6. The hooking device of a drawer to a longitudinal guide of claim 1, wherein said support body exhibits at least a third part of body connected slidably to the said first part of body and positionable adjustably in a second direction both parallel to a plan of the drawer and perpendicularly to the longitudinal direction of the guide, said second part of body being further slidably connected to the third part of body and positionable adjustably in the longitudinal direction of the guide, third adjustment means further being provided, destined to vruy the position of an assembly comprising said second part of body and third part of body with respect to the said first part of body in the said second direction for laterally adjusting the position of the drawer with respect to the guide.

7. The hooking device of a drawer to a longitudinal guide of the claim 6, wherein said third adjustment means are positioned on a same side as said first adjustment means with respect to the fulcrum of oscillation of the lever.

8. The hooking device of a drawer to a longitudinal guide of claim 6 wherein said first adjustment means comprise a cylindrical pin constrained rotatably in a cylindrical guide hole afforded on said third part of body and a cam supported by said pin in an eccentric position and engaged in a slot afforded on said second part of body.

9. The hooking device of a drawer to a longitudinal guide of claim 8, wherein said first adjustment means further comprise a manual gripping element for activating said cam.

10. The hooking device of a drawer to a longitudinal guide of claim 6, wherein said third adjustment means comprise a cylindrical pin constrained rotatably in a cylindrical guide hole afforded on said first part of body, and a cam supported in an eccentric position by said pin and engaged in a slot afforded on said third part of body.

11. The hooking device of a drawer to a longitudinal guide of claim 10, wherein said third adjustment means further comprise a manual gripping element for activating said cam.

12. The hooking device of a drawer to a longitudinal guide of claim 6, wherein the first part of body exhibits a plate having guide ribs which are perpendicular to the longitudinal direction of the guide and which cooperate with front and rear edges of a plate of the third part of body.

13. The hooking device of a drawer to a longitudinal guide of claim 6, wherein the third part of body exhibits a projection which develops in the longitudinal direction of the guide and is slidably engaged in a recess having a complementary shape thereto and afforded in the second part of body.

14. The hooking device of a drawer to a longitudinal guide of claim 1, wherein said first adjustment means comprise a wheel screwed coaxially on an endless screw, wherein the wheel is constrained to said first part of body such as to exhibit a single rotational degree of freedom about an axis thereof, said endless screw is fixed to said second part of body and oriented in the longitudinal direction of the guide.

15. The hooking device of a drawer to a longitudinal guide of claim 14, wherein said wheel is positioned in a seating afforded in said first of body on which an access window is superposed, afforded in said second part of body for manually activating the wheel.

16. The hooking device of a drawer to a longitudinal guide of claim 1, wherein the second part of body exhibits a base plate having perpendicular tabs that are parallel to one another and which slidably engage with corresponding perpendicular tabs of the first part of body for sliding the second part of body in the longitudinal direction of the guide.

* * * * *